US006033113A

United States Patent [19]

Anderson

[11] Patent Number: 6,033,113

[45] Date of Patent: Mar. 7, 2000

[54] SEAL FOR ZIPPER-TYPE PLASTIC BAGS AND THE LIKE

[75] Inventor: Brent G. Anderson, Barrington, Ill.

[73] Assignee: CTI Industries Corporation, Barrington, Ill.

[21] Appl. No.: 09/136,134

[22] Filed: Aug. 18, 1998

[51] Int. Cl.[7] ..... B65D 33/24

[52] U.S. Cl. ..... 383/63; 24/587

[58] Field of Search ..... 383/63, 64, 65; 24/587, 399, 400

[56] References Cited

U.S. PATENT DOCUMENTS

| | | | |
|---|---|---|---|
| Re. 34,117 | 10/1992 | Martin et al. | 383/63 |
| 2,144,755 | 1/1939 | Freedman | 383/65 |
| 3,338,285 | 8/1967 | Jaster | 383/65 |
| 3,339,606 | 9/1967 | Kugler | 383/63 |
| 3,395,788 | 8/1968 | Gill | 383/63 |
| 3,986,914 | 10/1976 | Howard . | |
| 4,484,352 | 11/1984 | Katzin | 383/65 |
| 4,523,918 | 6/1985 | Ausnit . | |
| 4,755,248 | 7/1988 | Geiger et al. | 383/63 |
| 4,822,539 | 4/1989 | Tilman et al. . | |
| 4,909,017 | 3/1990 | McMahon et al. | 383/63 |
| 4,925,318 | 5/1990 | Sorensen | 383/63 |
| 5,059,036 | 10/1991 | Richison et al. | 383/63 |
| 5,141,577 | 8/1992 | Porchia et al. . | |
| 5,878,468 | 3/1999 | Tomic et al. | 383/63 |

*Primary Examiner*—Stephen P. Garbe
*Attorney, Agent, or Firm*—Tilton, Fallon, Lungmus & Chestnut

[57] ABSTRACT

An improved zipper closure for plastic bags and other plastic containers is provided with fillets along uppermost and lowermost interlocking fingers of the zipper to prevent escape gaps from forming between the two sides of the zipper closure through which air or liquid would otherwise leak, especially at the bag's side seal locations. Conventional heat dies are used in combination with excess quantities of plastic material, either integrally formed, or, alternatively, co-extruded with, the zipper closure to form the fillets, thereby eliminating the need for use of a pressure differential-producing die to manufacture plastic bags without escape gaps.

3 Claims, 2 Drawing Sheets

SEAL FOR ZIPPER-TYPE PLASTIC BAGS AND THE LIKE

BACKGROUND

1. Field of the Invention

This invention relates generally to the improved sealing of plastic containers and, more specifically, to the addition of fillets to a zipper closure for plastic bags and similar containers in order to eliminate gaps formed between the two sides of the zipper closure which allow for leakage of air or liquid, particularly at the side seals of such containers.

2. Description of the Prior Art

Zipper closures have long been used to improve the sealing of, and simplify the closing of, plastic bags and similar containers. Plastic bags having zipper closures typically consist of two substantially similar-sized sheets of plastic film (usually supplied from a pair of continuous web spools or rolls) which are sealed together at a lower end of the sheets to form a front layer and a rear layer, with the seal forming a bottom edge of the bag (or, alternatively, the plastic bag may be formed by a length of bag film folded over upon itself to form a front layer and a rear layer connected by an integral bottom edge defined by the fold); and two opposing lengths of plastic film heat sealed along the inside of the upper edges of the front and rear layers of bag film, with each of the lengths of plastic film carrying two or more interdependent ridges. The lengths of film appear interdigitated in cross-section due to these interdependent ridges which form the zipper closure. Side edges of the plastic bag are typically sealed using a sealing head.

It is well-known that the zipper closure itself is air-tight along its length due to the releasable and reusable seal formed by the interdependent ridges. A long-standing problem in the art of zipper-sealed plastic bags or similar containers, however, has been the presence of escape gaps which are created during heat sealing at the outermost ridges (i.e. such as at the bag's two side seal locations) of the zipper closure. These undesirable gaps as formed by conventional in-line web type manufacturing of bags allow for air and/or liquid to leak into or out of the sides of a plastic bag. One major contributing factor causing the escape gaps is the abrupt change in profile between the ridge portions of one of the layers of the zipper closure and the relatively flat extensions of the opposite layer of the zipper closure. The relatively flat extensions are preferred, in that they provide convenient portions of plastic used to heat seal the respective layers of the zipper closer to the front and rear layers of the bag film.

Most problematic are the escape gaps located at the intersection of the zipper closure, the bag film, and the side edges of the plastic bag. These escape gaps are frequently formed as a result of applying continuous pressure and heat to seal the side edges of the bag, without making accommodations for the underlying zipper closure that is typically already heat sealed along the top edge of the bag film. Such escape gaps facilitate leakage of air and/or liquid directly into or out of the contents of the plastic bag, which can cause undesired spillage, contamination, and spoilage of such contents.

U.S. Pat. No. 3,986,914, issued to Howard, discloses one method for eliminating the escape gaps at the side edges of the bags, consisting of forming a bead seal at the junction of each outermost ridge of the zipper closure and the side edges of the plastic bag. The patent discloses forming the bead seal during heat-welding of the side edges of the plastic bag. The bead seal is made of plastic that is forced into the junctions during heating of the container and zipper closure by an apparatus called a pressure bar. The specially configured pressure bar includes a U-shaped indentation or channel, disposed so that the walls of the channel straddle and slightly pinch the zipper closure when the pressure bar and a cooperating surface (such as a sealing bar or an anvil) are in contact with one another. The U-shaped channel within the pressure bar provides a pressure differential which causes heated plastic to flow into the junctions, thus forming the bead seals.

One shortcoming of the method for making bead seals described in Howard (U.S. Pat. No. 3,986,914) is that the bead seals are formed as a separate step in the manufacturing process. Also, the pressure bar with the specially configured channel is not found on conventional bag-making machinery, but rather, manufacturing plants would need to be retrofitted with such pressure bars, thus incurring at least some additional cost, which may eventually have to be borne by consumers as an increase in the price of plastic bags. Another shortcoming of such method is that the U-shaped channel within the specially configured pressure bar must hit the zipper closure in a precise orientation each time it contacts the zipper closure. However, plastic film is difficult to keep in a proper orientation, particularly during an in-line web-type manufacturing process, wherein as the plastic film moves downstream it has a tendency to wander from side-to-side. As the U-shaped channel of the pressure bar disclosed in Howard contacts the plastic film, the relative orientation is hard to keep constant due to the side-to-side movement of the film. As a result, if the pressure bar misses the precise location of the zipper closure on a film web by merely a fraction of an inch, many of the resulting plastic bags must be rejected as unusable when made in the prior art process as disclosed by Howard. The present inventor believes that this drawback of Howard is why, despite that patent being issued more than twenty years ago, no manufacturers in the plastic bag-making industry are believed to be currently using the Howard process.

Yet another drawback of the method disclosed in the Howard patent is that there is only inferior means for sealing the zipper ends together. If the zipper ends are not adequately sealed together, they will leak. The Howard method requires use of high, concentrated pressure in order to seal the ends of the zipper, which is known in the art as "smashing" the zipper, and which does not always create an adequate seal at the ends of the zipper closure.

Another practical consideration that makes the Howard process inferior is that, although the process does attempt to reduce escape gaps, it does so by deforming the actual sealing profile of the zipper closure. By borrowing material from the interlocking portions of the zipper closure to close escape gaps, the Howard process undesirably compromises the integrity of the zipper seal. Thus, although plastic bags made by the Howard process may be more leak-resistant (i.e. more gas-tight and liquid-tight) at rest than those bags made by other conventional techniques that did not eliminate escape gaps, such bags made by the Howard process would tend to open prematurely when subjected to even minor forces, for example when the contents of a plastic bag falls against the zipper closure.

Another conventional attempt of increasing the leak-resistance of plastic bags having zipper closures has been to preheat the areas where the zipper closure meets the side edges of the plastic bag. This prior art technique is demonstrated in FIGS. 1 and 2 of the present application. FIG. 1 shows an enlarged cross-section, rotated 90° for convenience, of a conventional two-part zipper closure member 11 taken along a side edge of a plastic bag 10, just after the bag-making stages wherein the two parts of the zipper closure 12, 16 are respectively heat sealed to the front and rear layers 14, 18 of the bag, and before the sides of the two layers of the zipper closure are melted together (i.e., at the extreme side edges of the plastic bag 10). The front part of the zipper closure bearing reference number 12 is adjacent to the front layer 14 of the plastic bag, and the rear part of the zipper closure, bearing reference number 16, is adjacent to the rear layer 18 of the plastic bag.

FIG. 2 demonstrates the problem of escape gaps present in prior art devices which form in part because the melting of the sides of the zipper closure is typically uneven and cannot be relied upon to completely eliminate escape gaps at the outer ridges of the zipper closure. As a result, air and liquid can still leak out the sides of the plastic bag at the intersection of the bag's side edges and the zipper closure. During the side edge sealing step, which consists of exposing the sides of the bag 10 to a sealing head, the front layer 14 and rear layer 18 of the bag 10 below the zipper closure are sealed together along a seam designated by reference number 20. By preheating the sides of the layers 12, 16 of the zipper closure prior to exposing the bag 10 to the sealing head, the relatively flat portions 30, 31 and 32, 33 of the zipper closure layers melt together during the side edge sealing step along melt lines 22 and 24. However, as shown in FIG. 2 and due in part to the abrupt change in profile between the ridge portions 26, 28 of the rear zipper closure layer and the flat portions 30, 32 of the front zipper closure layer, escape gaps 34, 36 form, thus allowing leakage of air and liquid through the zipper closure at the side edges of the plastic bag 10.

One object of the present invention is therefore to eliminate formation of the undesirable escape gaps between the ridges of the zipper closure by providing a means for making the change in profile between the ridge portion of the zipper closure and the rest of the bag film more gradual. Another object of the present invention is to provide zipper closures for plastic bags and similar containers that are air-tight and liquid-tight, even along their side edges.

Yet another object is to reduce the number of rejected, unusable plastic bags from the number of rejects produced by manufacturing processes of the prior art. An additional object of the present invention is to provide a zipper-type plastic bag manufacturing process suitable to practice using existing, conventional heat dies in an in-line web-type process, such that there is no need for the use of a pressure differential-producing die to impart any special profiles to the zipper closure of the plastic bags. The manner in which these and other objects of the invention are accomplished will become clear from the Summary of the Invention, the Detailed Description of the Preferred Embodiments, and the accompanying drawings.

SUMMARY OF THE INVENTION

The present invention achieves an air-tight and liquid-tight zipper closure-type plastic bag by eliminating unwanted escape gaps at the intersection of the zipper closure and the side edges of the bag and across the entire length of the zipper closure. The escape gaps are eliminated by adding a mass of material to the zipper closure at the boundaries where such escape gaps otherwise occur. In a first embodiment of the present invention, the extra mass is composed of the same material as the layers of the zipper closure. In an alternate embodiment, the extra mass is a co-extruded material that preferably shares at least some characteristics with the material of the layers of the zipper closure, such as low melting point, but also exhibits a higher flow rate than the material of the zipper closure when heated to a liquified state. By having a higher relative flow rate for the co-extruded material as compared to the material of the zipper closure, escape gaps are more completely filled by the fillets, as opposed to when the co-extruded extra mass is made of a material having a similar or lower flow rate than the material of the zipper closure.

DETAILED DESCRIPTION OF THE PREFERRED EMBODIMENTS

Figure 1:
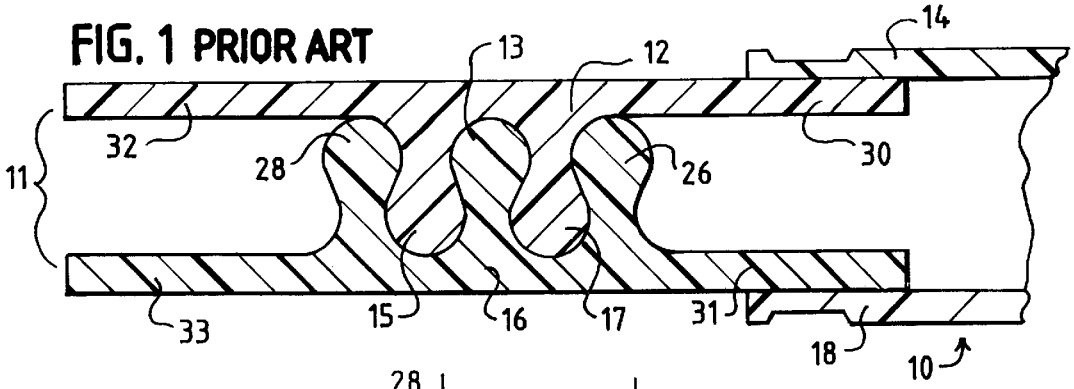
FIG. 1 PRIOR ART
FIG. 1 is an enlarged cross-section of a conventional (prior art) two-part zipper closure member taken along a side edge of a plastic bag prior to heat sealing.
Figure 2:
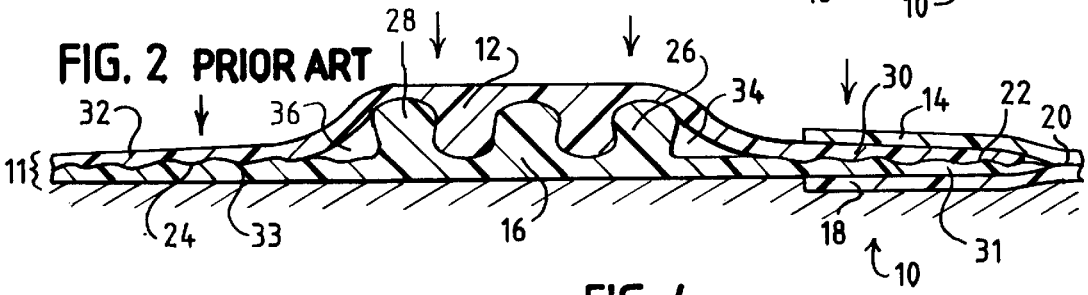
FIG. 2 PRIOR ART
FIG. 2 is an enlarged cross-section of the conventional (prior art) two-part zipper closure member shown in FIG. 1 after preheating of the zipper closure member and heat sealing of the zipper closure and bag layers.

The improved zipper closure of the present invention eliminates unwanted escape gaps which otherwise existed at the intersection of conventional zipper closures and the side edges of the bags to which the zipper closures were sealed. As shown in the prior art representation of the plastic bag 10 in FIGS. 1 and 2, a conventional zipper closure 11 operates by interlocking fingers 15, 17 along the front layer 12 of the zipper closure 11 with complimentary fingers 13, 26, 28 along the rear layer 16 of the zipper closure 11. The relatively flat portions 30, 31 extending along the bottom of zipper closure 11 provide areas of the zipper closure that are used to heat seal the zipper closure 11 to the front and rear layers 14, 18 of the plastic bag 10. Flat portions 30, 31 are also melted together along melt line 22 only along the outermost or side edges of the zipper closure 11, as shown in FIG. 2.

The relatively flat portions 32, 33 which extend along the top of the zipper closure 11 are melted together along melt line 24 only at the side edges of the zipper closure 11, and provide a convenient opening handle along the upper edge of the zipper closed plastic bag. The conventional zipper closure 11 suffers from the existence of escape gaps 34 and 36 at the intersection of the zipper closure 11 and the side edges of the plastic bag 10. Such an escape gap 34 of prior art zipper closure bag manufacturing processes is particularly troublesome, inasmuch as it permits gas and/or liquid to leak into and out of the interior of plastic bag 10, thus preventing a completely air-tight, liquid-tight sealed environment. As a result, perishable food products or any other items placed inside the bag 10 for isolation tend to spoil or become contaminated earlier than if the bag 10 did not have the escape gap 34.

Figure 3:
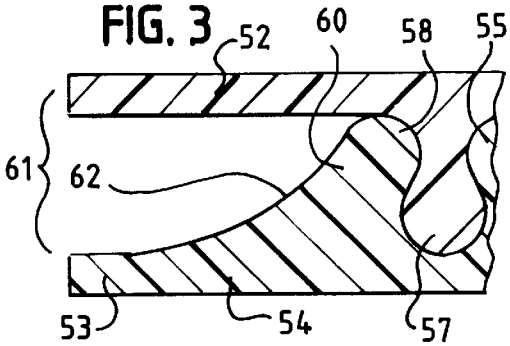
FIG. 3 is an enlarged cross-section of the improved zipper closure of the present invention, cut away, having extra mass made of the same material as the layers of the zipper closure in the area where escape gaps would otherwise form.

Turning now to FIG. 3, which is a representation of a first embodiment of the present invention (rotated 90°), a zipper closure 61 consists of a front layer 52 and a rear layer 54. The zipper closure 61 is operated in the conventional manner by interlocking fingers 55, 58 of the rear layer 54 with the corresponding finger 57 of the front layer 52. Only the upper half of the zipper closure 61 is shown in FIG. 3 in order to provide a side-by-side comparison of the first embodiment of the present invention with FIG. 4, which depicts the lower half of a zipper closure in an alternate embodiment of the invention (also rotated 90°).

The first embodiment eliminates escape gaps by filling the region between the outermost fingers of the rear layer 54, such as finger 58 and the relatively flat portions, such as flat portion 53 of the rear layer 54 of the zipper closure 61 with a fillet 60. The location of fillet 60 is advantageously placed where escape gaps would otherwise form. In this embodiment, the fillet 60 is made of the same plastic material as the zipper closure 61 such as a polyethylene material. The outer edge 62 of fillet 60 melts together with the front layer 52 of the zipper closure 61. As will be appreciated by those of ordinary skill in the art, the zipper closure 61 could be flipped such that the fillets 60 are placed onto fingers that are instead located on the front layer of the zipper closure 61. Alternatively, the zipper closure could have a design in which there is an outermost finger on each of the two layers of the zipper closure, wherein a fillet 60 would be added to each of the front and the rear layers of the zipper closure without departing from the scope of the present invention.

Figure 5:
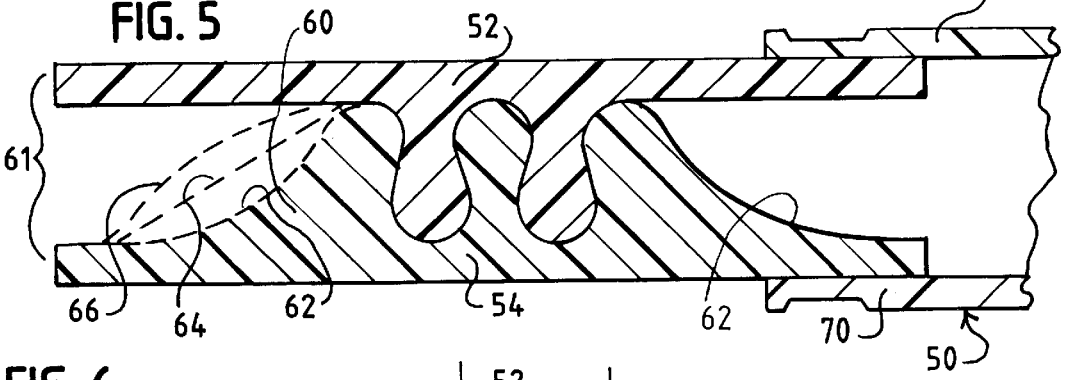
FIG. 5 is an enlarged cross-section of the improved zipper closure of the present invention, with broken lines representing various possible alternate profiles for the extra mass used to eliminate escape gaps.
Figure 6:
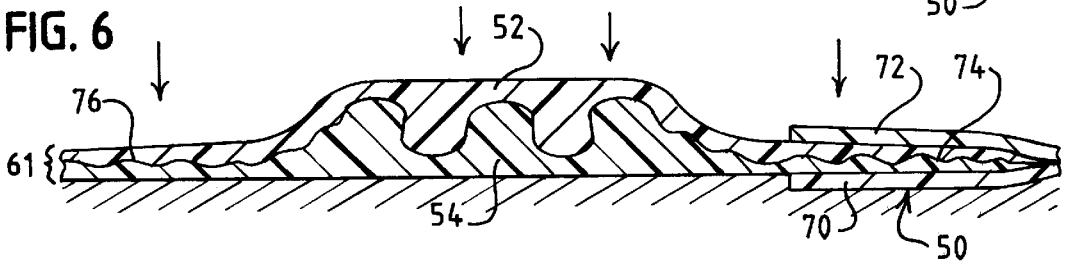
FIG. 6 is an enlarged cross-section of the improved zipper closure of the present invention after heat sealing of the sides of the zipper closure and bag layers.

FIG. 5 demonstrates that the profile of the fillet 60 may be concave, thus having outer edge 62; or may be inclined, thus having outer edge 64; or may be convex, thus having outer edge 66. In any of these profiles for fillets 60, when the side edges of the plastic bag 50 and zipper closure 61 are exposed to a heat source such as a sealing head, each outer fillet edge 62, 64 or 66 will advantageously melt together with the opposing layer 52 of the zipper closure 61 along melt lines 74, 76, as shown in FIG. 6. The arrows in FIG. 6 demonstrate the direction in which pressure is applied by the sealing head to seal the side edges of the zipper closure 61 and the side edges of the rear layer 70 and front layer 72 of the plastic bag 50.

Figure 4:
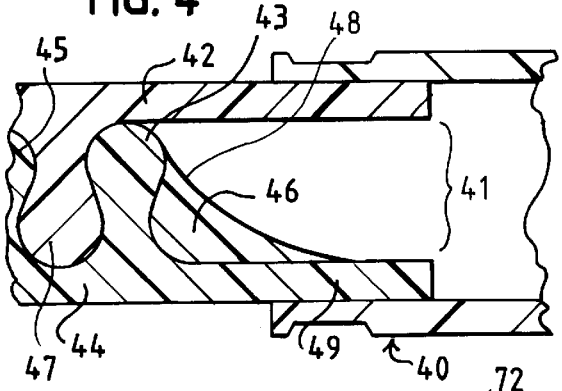
FIG. 4 is an enlarged cross-section of an alternate embodiment of the zipper closure of the present invention, cut away, having a co-extruded extra mass made of a different material from the layers of the zipper closure in the area where escape gaps would otherwise form.

An alternate embodiment of the present invention is shown in FIG. 4. Again, the zipper closure operates in the conventional manner, by interlocking fingers 43, 45 of the rear layer 44 with the finger 47 of the front layer 42 of the zipper closure 41. To eliminate unwanted escape gaps, a fillet 46 is added to the zipper closure 41 in the region between the outermost fingers, such as finger 43, and the relatively flat portions of the rear layer 44, such as flat portion 49. However, instead of being formed of the same plastic material as the zipper closure 41, fillet 46 is made of a different material and is co-extruded with the zipper closure 41. Generally, polyethylene is a suitable material to use for forming the zipper closure 41. Preferably, fillet 46 is made of a different plastic material that either shares the same flow rate (when heated to a liquid or semi-solid state) as the zipper closure 41, or exhibits higher flow characteristics than the material of the zipper closure 41. A suitable such different material for the fillets 60 is a blend of polyurethene and EVA (Ethylene Vinyl Acetate) or a blend of polyethylene and Surlyn™, available from DuPont.

Exemplary Method of Manufacture

Figure 7:
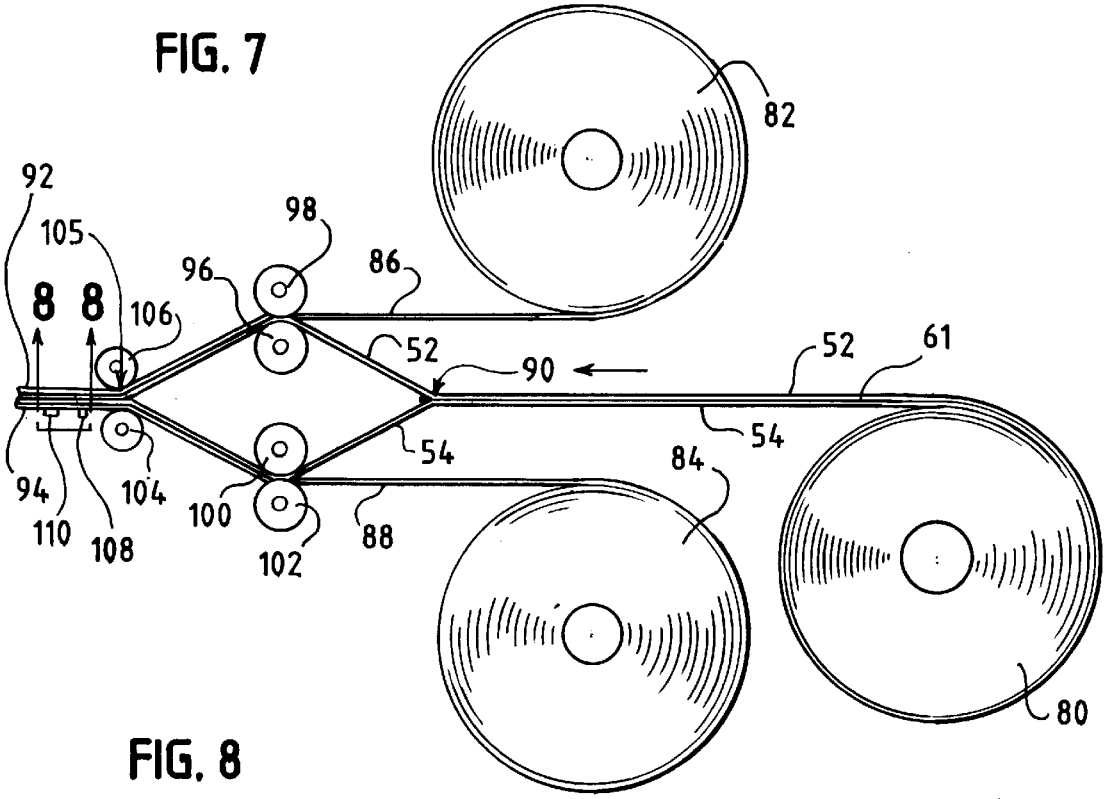
FIG. 7 is a schematic front plan view of an in-line web assembly of plastic bags having zipper closures sealed thereto.
Figure 8:
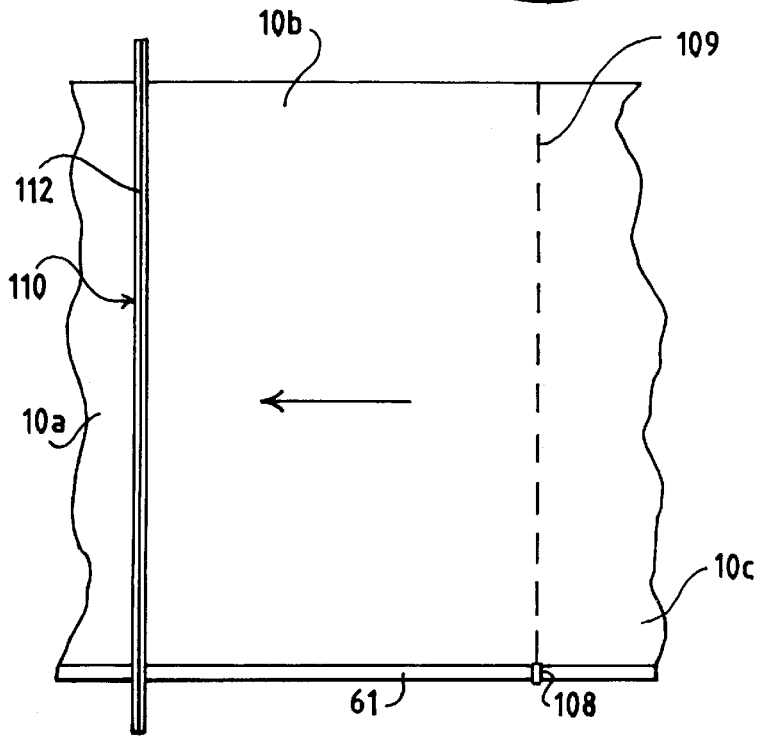
FIG. 8 is an exploded cross section, partially cut away, taken along lines 8—8 of FIG. 7, showing the final stages of manufacturing improved zipper closure plastic bags according to the teachings of the present invention.

An exemplary method for manufacturing plastic bags having the improved zipper closures of the present invention is shown in FIGS. 7 and 8. As shown in FIG. 7, a conventional in-line web assembly process incorporates a continuous-feed zipper roll 80, a top web spool 82, and a bottom web spool 84. The top web spool 82 continuously supplies front plastic film web 86 to eventually form the front layer 92 of plastic bags 10*a*, 10*b*, 10*c* (see FIG. 8). Simultaneously, the bottom web spool 84 continuously supplies rear plastic film web 88 to eventually form the rear layer 94 of plastic bags 10*a*, 10*b*, 10*c*. The zipper roll 80 continuously feeds a supply of pre-formed, unseparated zipper closures 61. The upstream to downstream direction of the manufacturing process is right to left on the drawings, as indicated by the arrows in FIGS. 7 and 8.

The front layer 52 and rear layer 54 of the continuously fed supply of zipper closures 61 are separated from one another after coming off of the zipper roll 80 by the zipper separator 90. Alternatively, it is recognized that the zippers can instead be attached without separating them, for example by staggering the connection points to the front plastic film web 86 and the rear plastic film web 88, or by having the front plastic film web 86 and rear plastic film web 88 located in very close proximity to one another. The front layer 52 of the zipper closure 61 is then heat sealed between upper sealing rollers 96, 98 to an upper end of the front plastic film web 86 to eventually form the upper end of the front layer 92 of the plastic bags 10*a*, 10*b*, 10*c*. In a similar fashion, the rear layer 54 of the zipper closure 61 is heat sealed between lower sealing rollers 100, 102 to an upper end of the rear plastic film web 88 to eventually form the upper end of the rear layer 94 of the plastic bags 10*a*, 10*b*, 10*c*.

After the front layer 52 and rear layer 54 of the zipper closure 61 are secured to the respective plastic film webs 86, 88 (i.e., after one-half of the zipper closure 61 is sealed to the front plastic film web 86 and the other half of the zipper closure 61 is sealed to the rear plastic film web 88, or alternatively, after an unseparated zipper closure 61 is sealed to both the front plastic film web 86 and the rear plastic film web 88), the plastic webs 86, 88 are joined together by rollers 104, 106. Rollers 104, 106 provide two functions. First, they provide a means to heat seal a lowermost edge of the plastic film webs 86, 88 to form a bottom edge of the plastic bags 10*a*, 10*b*, 10*c*. Also, rollers 104, 106 re-close the front layer 52 and rear layer 54 of the zipper closure at a locking point 105 before the final stations of the manufacturing process where, among other processing, cutting of the plastic bags 10*a*, 10*b*, 10*c* occurs.

It will be recognized by those of ordinary skill in the art that, if a single, center-folded sheet of plastic film is used instead of a pair of upper and lower plastic film webs 86, 88 to form the plastic bag, then the heat sealing means to form the bottom edge of the plastic bags 10*a*, 10*b*, 10*c* is unnecessary, and only a single web spool would be required in lieu of the two web spools 82, 84. In such a case, the fold would define the bottom edge of the plastic bags.

Turning to FIG. 8, downstream of rollers 104, 106 are zipper preheating, and cross sealing/plastic bag cutting stations of the in-line assembly process, both of which are conventional in the art. At the lower right corner of FIG. 8, a preheat-crush zone die head 108 is applied to the area of zipper closure 61 where the side heat seal will be applied. The preheat-crush zone die head 108 sufficiently melts the fillet material until the fillet material reaches a liquified state, and smashes the profile of the zipper closure in the area where the side edges of the bags 10*a,* 10*b,* 10*c* will be located. The pre-heat crush zone die head 108 thus provides a pre-heating means and may take the form of an ultrasonic heat source, a resistive heat source (e.g., an electric coil), or any other heating element that can be used to repeatedly provide heat to a concentrated area for a short duration of time.

The fillet material is either formed integrally with the zipper closure 61, or alternatively, is co-extruded with the zipper closure upstream of the zipper separator 90. When co-extruded with the zipper closure, the fillet material is preferably made of a blend of polyurethane and EVA, which exhibits a higher flow rate when heated to a liquid state than the plastic (e.g. polyethylene) used to form the zipper closure. The higher relative flow rate of the polyurethane causes the fillets to better fill the areas around the upper and lower edges of the zipper closure 61 where escape gaps would otherwise normally be formed.

Dashed line 109 represents the region where bags 10*b* and 10*c* will soon be sealed along their adjoining side edge, then cut by the cross sealing/plastic bag cutting station 110. The pre-heat crush zone die head 108 is located at the upper edge of the web films 86, 88 along the dashed line 109 and is intermittently brought into contact with the zipper closure 61 so as to pre-heat an intersection of the zipper closure 61 and the front and rear layers 92, 94 at a location where the outermost or side edges of adjacent bags, e.g., bags 10*b* and 10*c,* will be formed once separated from one another along the web. The preheat crush zone die head 108 is positioned a fixed distance from the cross sealing/plastic bag cutting station 110, with that fixed distance being equal to the width of one of the bags 10*a,* 10*b,* 10*c.* The web films 86, 88 are preferably brought to a rest long enough to allow the pre-heat crush zone die head 108 and the cross sealing/plastic bag cutting station 110 to contact the web films 86, 88 and perform their respective functions. The preheat crush zone die head 108 and the cross sealing/plastic bag cutting station 110 may act in tandem, repeatedly simultaneously performing their respective functions on the web films 86, 88, while located a fixed distance from one another. This distance is known in the art as "one repeat," since it is intended to take exactly one cycle of the web films 86, 88 advancing and stopping for the work area of the web films 86, 88 (shown by dashed line 109) to travel from the pre-heat crush zone die head 108 to the cross sealing/plastic bag cutting station 110.

The cross sealing/plastic bag cutting station 110 provides a side heat seal to form the side edges 92, 94 of the plastic bags 10*a,* 10*b,* 10*c,* as well as seal the left and right side edges of the zipper closure. A sharp blade 112 (or, alternatively, a hot wire) in the cross sealing/plastic bag cutting station 110 severs adjacent bags apart from one another by cutting through the center of the side heat seal once formed. The resulting plastic bag, e.g. bag 10*a,* is thus formed having no unwanted escape gaps, thereby greatly enhancing the bag's ability to keep food products within the bag fresh (i.e., avoiding early spoilage of the bag's contents).

Although the invention has been described with respect to certain embodiments thereof, it will be understood by those of ordinary skill in the art that it is not intended to be limited thereto, and that modifications may be made to the embodiments disclosed that are still within the scope of the appended claims.

What is claimed is:

1. A zipper closure in combination with a plastic bag, said combination being gas-tight and comprising:

a plastic bag having a front layer, a rear layer attached to said front layer by attachment means therebetween along a lowermost end of the plastic bag, a top edge, and two side edges;

a front layer of said zipper closure having a lowermost flat portion extending downwardly and being in sealed communication with an inside surface of the top edge of said front layer of the plastic bag a rear layer of said zipper closure having a lower flat portion extending downwardly and being in sealed communication with an inside surface of the top edge of said rear layer of the plastic bag;

a plurality of interlocking fingers extending the length of said front and rear layers of said zipper closure, with a lowermost finger of each of said layers of the zipper closure being located above said lowermost flat portion of the corresponding layer of the zipper closure; and a gap-filling fillet extending between the lowest of said lowermost fingers and the corresponding lower flat portion of said zipper closure, said fillet providing a gas tight seal to prevent gas from leaking through said plastic bag, wherein said fillet is formed of a different material than said zipper closure.

2. The combination of claim 1, wherein said fillet comprises a material which, when heated to a liquified state, has a higher flow rate than a material of said zipper closure in a liquified state.

3. The combination of claim 2, wherein said fillet material comprises a blend of polyethylene and Ethylene Vinyl Acetate.

* * * * *